US008453852B2

(12) United States Patent
Raddatz

(10) Patent No.: US 8,453,852 B2
(45) Date of Patent: Jun. 4, 2013

(54) DRYING RACK

(76) Inventor: Douglas Lowell Raddatz, Fayetteville, NC (US)

( * ) Notice: Subject to any disclaimer, the term of this patent is extended or adjusted under 35 U.S.C. 154(b) by 391 days.

(21) Appl. No.: 12/730,332

(22) Filed: Mar. 24, 2010

(65) Prior Publication Data

US 2011/0233163 A1 Sep. 29, 2011

(51) Int. Cl.

| | |
|---|---|
| ***D06F 57/12*** | (2006.01) |
| ***A47G 25/0685*** | (2012.01) |
| ***A47G 25/746*** | (2012.01) |
| ***A47F 5/0807*** | (2012.01) |

(52) U.S. Cl.

USPC ..... 211/85.24; 211/104; 211/96; 211/202; 211/88.04

(58) Field of Classification Search

CPC ..... A47K 10/06; A47K 10/04; D06F 57/12; D06F 57/10; A47G 25/0685; A47G 25/746; A47B 61/02; A47B 61/003; A47B 43/00; A47F 5/0807; A47F 5/08

USPC ..... 211/85.24, 119.004, 198, 113, 202, 211/195, 96–104, 87.01, 197, 1.3, 200, 204, 211/206, 6, 16, 88.04, 85.3; D32/58

See application file for complete search history.

(56) References Cited

U.S. PATENT DOCUMENTS

| | | | | | |
|---|---|---|---|---|---|
| 886,116 | A | * | 4/1908 | Custer | 211/113 |
| 1,367,697 | A | | 2/1921 | Hagerman | |
| 1,545,072 | A | * | 7/1925 | Stearns | 211/198 |
| 1,628,936 | A | * | 5/1927 | Turner | 211/119.011 |
| 1,962,205 | A | * | 6/1934 | Murray | 211/104 |
| D136,015 | S | * | 7/1943 | Luger | D32/58 |
| 2,443,859 | A | * | 6/1948 | Jacobs | 248/251 |
| D161,594 | S | | 1/1951 | Roop | |
| 2,950,822 | A | * | 8/1960 | Cope | 211/104 |
| 2,958,424 | A | * | 11/1960 | Bigatti | 211/41.5 |
| 3,132,745 | A | * | 5/1964 | Steiner | 211/119.1 |
| 3,133,645 | A | * | 5/1964 | Cecil | 211/202 |
| 3,741,402 | A | * | 6/1973 | Russell | 211/104 |
| 4,712,692 | A | * | 12/1987 | Peinsipp | 211/119 |
| 4,739,888 | A | * | 4/1988 | Steiner | 211/198 |
| 4,779,914 | A | * | 10/1988 | Friedline | 294/143 |
| 4,846,356 | A | | 7/1989 | Dubuc | |
| 4,901,871 | A | * | 2/1990 | Ohm et al. | 211/119.004 |
| 5,019,126 | A | * | 5/1991 | Post | 211/104 |
| 5,170,719 | A | * | 12/1992 | Pestone | 108/48 |
| 5,178,287 | A | * | 1/1993 | Klein et al. | 211/100 |
| 5,927,519 | A | * | 7/1999 | Koonts et al. | 211/85.7 |
| D417,536 | S | * | 12/1999 | Sum | D32/58 |

(Continued)

OTHER PUBLICATIONS

Madison Wall-Mounted Laundry Drying Rack, Towel Racks, Bathroom Organization, http://www.homedecorators.com/P/Madison_Wall-Mounted_Laundry_Drying_Rack/, Apr. 22, 2010, Home Decorators Collection, 8920 Pershall Road, Hazelwood, MO 63042.

(Continued)

*Primary Examiner* — Jennifer E Novosad

(74) *Attorney, Agent, or Firm* — James G. Passe; Passe Intellectual Property, LLC

(57) ABSTRACT

The present invention relates to a clothes drying rack consisting of two separate rectangular racks which are mounted against the wall to form a mountain fold configuration, but can be folded flat against the wall for storage when not in use.

5 Claims, 4 Drawing Sheets

U.S. PATENT DOCUMENTS

| | | | | |
|---|---|---|---|---|
| 6,234,329 | B1 * | 5/2001 | Loew | 211/104 |
| 6,283,314 | B1 * | 9/2001 | Loguercio | 211/200 |
| 6,299,000 | B1 * | 10/2001 | Cabrera | 211/70.2 |
| 6,464,091 | B1 | 10/2002 | Nagasaki | |
| 2002/0166829 | A1 * | 11/2002 | Koellner | 211/104 |
| 2008/0053936 | A1 * | 3/2008 | Seehoff | 211/104 |
| 2011/0233163 | A1 * | 9/2011 | Raddatz | 211/85.3 |

OTHER PUBLICATIONS

Pullout Wooden Clothes Drying Rack-Wall Mount Drying Racks, http://www.stacksandstacks.com/pullout-wooden-clothes-drying-rack, Apr. 22, 2010,Stacks and Stacks.

* cited by examiner

DRYING RACK

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

1. Field of the Invention

The present invention relates to a drying rack. In particular, the present invention relates to a drying rack that is wall mountable and easily folds away.

2. Description of Related Art

When washing clothing, there are basically two choices for drying the wet clothes. One can either place them in a clothes dryer of the electric or gas kind, or one can air dry them. Air drying is considerably cheaper since no fuel or machine is used in the process, however, if the clothes are not somehow hung, they will wrinkle and not dry evenly. If they are hung too close to one another such that they touch, they can also have drying and wrinkling problems.

Accordingly, numerous methods for hanging clothes abound, however, hangers designed for dry clothing are generally not suited for use with wet clothing. Dry clothing can touch one another and be bunched up more so than wet clothing and since dry clothing is not as heavy as wet clothing, hangers for dry clothing can be lighter weight construction, ignoring the fact that water can double or more the weight of a washed piece of clothing. Further, devices for hanging dry clothing can be made of materials that are completely unsuitable for use with wet clothing as some materials can react with a garment if it is wet, more easily transfer dirt, or the like to the garment.

Because the drying of clothing can take up a large amount of room, if one is air drying, it is not uncommon a solution to have a folding or collapsing rack. However, most take up large amounts of room even though they fold up and many that fold are very small and those that don't have storage room problems.

In U.S. Pat. No. 4,846,356 issued Jul. 11, 1989 to Dubuc, there is a clothes drying rack adapted to be fixed to a ceiling between lateral walls surrounding a bathtub. The frame is supported to the ceiling by a pair of brackets having a flange in the plane of frame.

In U.S. Pat. No. 2,950,822 issued Aug. 30, 1960 to Coope, there is disclosed a collapsible clothes drying rack that requires a bracket and reinforcing rods to support the device yet only has 5 cross members for supporting wet clothing, thus, taking up a large amount of room for a small amount of clothing in order to have a rack which is wall mounted and collapses in a side to side manner.

BRIEF SUMMARY OF THE INVENTION

The present invention relates to the discovery that a folding clothing rack that folds inwardly and folds down to provide an angled clothes drying device is an improvement on the previous ways of assembling drying racks and provides the possibility of more drying rods than previous devices for drying clothing.

Accordingly, in one embodiment, the present invention relates to a folding clothes drying rack adapted to be fixed to a wall surface comprising:

a) a horizontal wall mounting top bar having a pair of spaced apart wall spacers;

b) a first rectangular rack comprising:

i. a pair of vertical rod holders, each having a top end and a bottom end, positioned for holding clothes drying rods in parallel spaced relationship wherein the rod holders are spaced apart the same distance as the wall spacers;

ii. a plurality of clothes drying rods positioned between the rod holders such spaced to allow the hanging of wet clothing; and iii. a hinge for attaching each of the top end of the vertical rod holders to the wall spacers;

c) a second rectangular rack comprising:

i. a pair of vertical rod holders each having a top end and a bottom end, positioned for holding clothes drying rods in parallel spaced relationship wherein the rod holders are spaced apart the same distance as the wall spacers;

ii. a plurality of clothes drying rods positioned between the rod holders such spaced to allow the hanging of wet clothing; and iii. a hinge for attaching each of the top end of the vertical rod holders to the bottom end of the respective first rectangular rack vertical rod holders;

d) wherein the rack has a closed position wherein the second rack is folded underneath the first rack and up against a wall to which it is mounted; and e) wherein the rack has an open position wherein the second rack is folded downward below the first rack such that the bottom end of the second rack bottom ends are against a wall to which the rack is mounted forming a mountain fold against the wall.

DETAILED DESCRIPTION OF THE INVENTION

Figure 1:
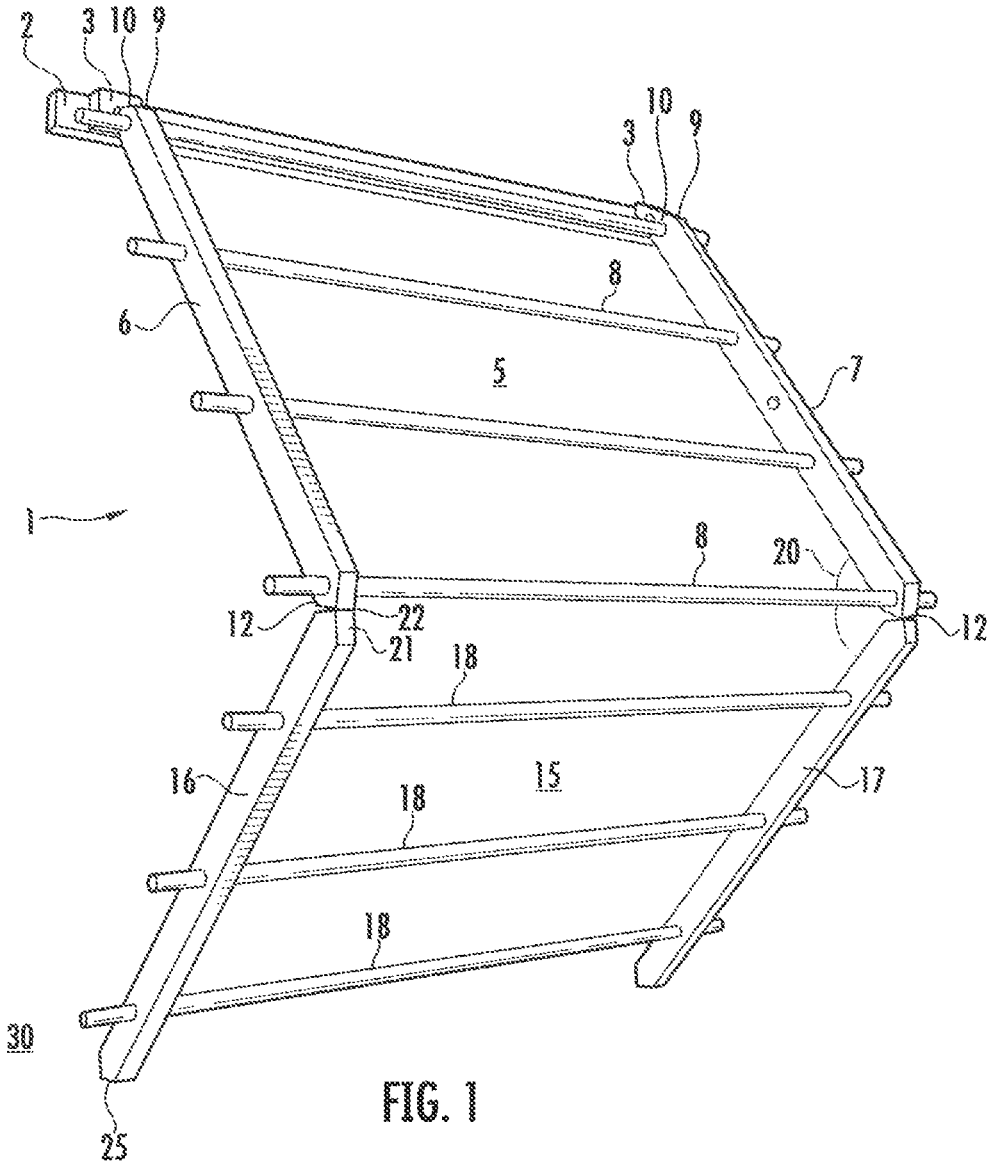
FIG. 1 is a perspective view of an embodiment of the present invention in the open position.

While this invention is susceptible to embodiment in many different forms, there is shown in the drawings and will herein be described in detail specific embodiments with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings. This detailed description defines the meaning of the terms used herein and specifically describes embodiments in order for those skilled in the art to practice the invention.

DEFINITIONS

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein, is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are for the purpose of illustrating certain convenient embodiments of the present invention and are not to be considered as limitation thereto. Term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

A "drying rack", as used herein, refers to a device with a plurality of horizontal rods for hanging wet clothes on spaced to allow the clothes to hang without touching other clothing on the rack. Rods can be made of wood, plastic, metal, or any material that will not react or damage the wet clothing. In the use of the present invention, the rods are spaced both horizontally and vertically from one another, as can be seen in the drawings, and as such optimize the use of space without having to extend to unreasonable lengths away from a wall to which it is mounted.

Figure 2:
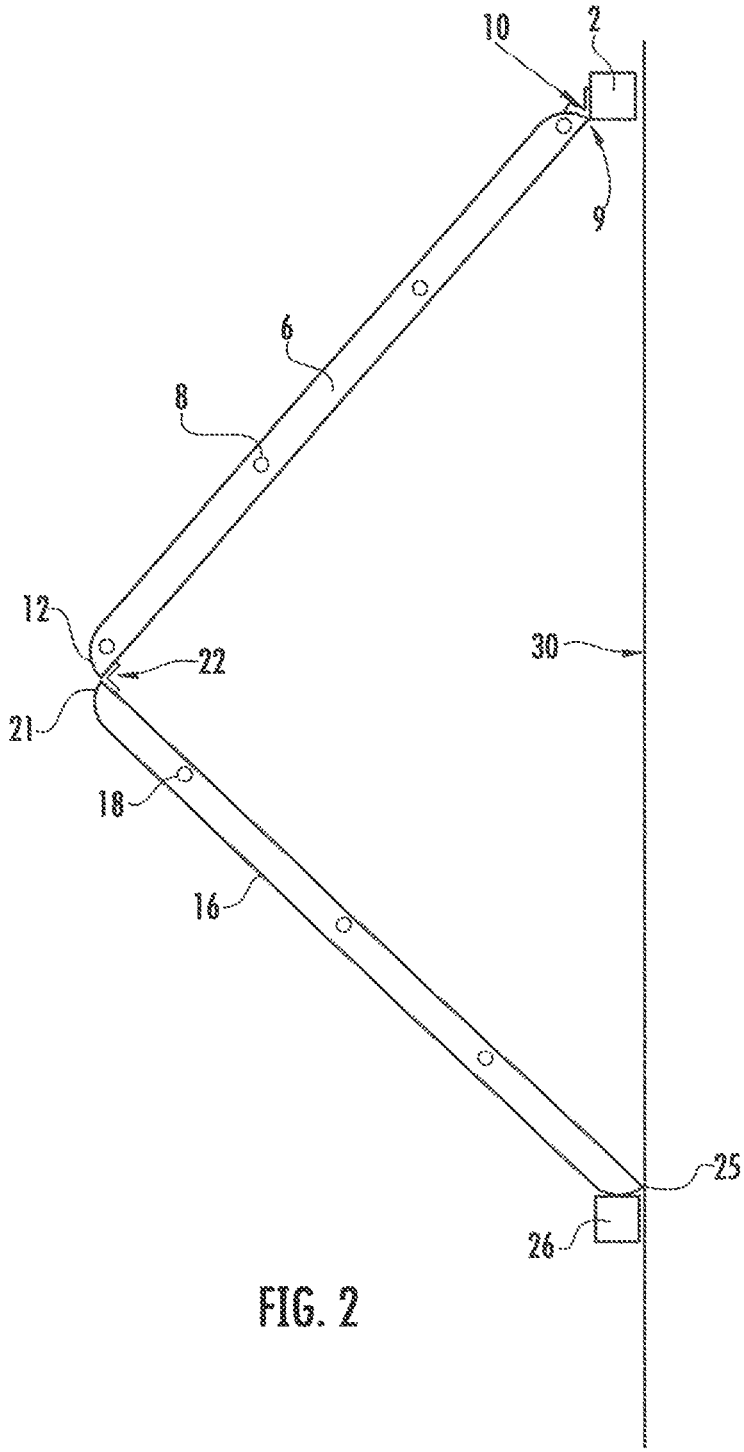
FIG. 2 is a side view of an embodiment of the present invention in the open position.

A horizontal wall mounting bar, such as a 1 by 2, a 1 by 3, or the like piece of lumber, can be used for the horizontal bar. The bar can be made of wood, plastic, metal, or the like, but is designed to be mounted to the wall and be at least as long as the width of the rack portion of the invention. The mounting bar can be attached to a wall by toggle bolts, screwed into the joists, or in some cases, glued to the wall. The thickness of the mounting bar and the wall spacers used to attach the racks is such that the thickness of the two combined is equal to about the thickness of the two folding racks such that when folded against the wall, the second rack lays essentially flat. This can be achieved by using a thin bar and spacers to make up the distance as shown in FIG. 1 which follows, or as shown in FIG. 2, a single, thicker bar wherein the wall spacers are part of the bar by virtue of its thickness. While using spacers lowers the amount of material used in building the rack, it uses less labor to use a single thick bar. The choice is one of preference of the particular user.

The drying rack consists of two rectangular racks which fold up against the wall when not in use with the second rack underneath the first rack and fold outward to create the rack in the open position. The two racks can be the same size or the second rack can be smaller than the first but since it needs to fold underneath the first rack, its size is limited by the position of the mounting bar. The first rectangular rack comprises a pair of vertical sides which hold the desired number of clothes drying rods. The rods hold the sides in spaced relationship parallel to one another. Each of the side has a top and a bottom. The sides can be made of wood, plastic, metal, or the like. The top and bottom of the rectangular rack can be just the rods, or in one embodiment, a top and bottom cross piece can be utilized to form a rectangle. While not shown in the drawings, one skilled in the art could make such an addition.

The top ends of the sides of the first rack are spaced the same distance as the wall spacers. If just a thick bar is used as the top bar, then the sides can be spaced any distance as long as they both can be mounted on the top bar. Either way, the top ends are attached to the wall spacers or top bar by means of a hinge that allows the rack to move to and from the wall as seen in the drawings. There is no reason for a limit on the hinge, but in an embodiment, there is a limit to the range of the hinge, thus, it can only swing out a desired amount.

The second rectangular rack is constructed just like the first rack though the lengths of the side can be different, though one embodiment is where they are all the same length as shown in the drawings. The second rack has the sides spaced apart the same distance as the first rack so that the top ends of the sides of the second rack can attach to the bottom ends of the sides of the first rack. The number of drying rods between each of the rectangular racks will depend on the length of the sides and the desired distance between the rods. In addition, the overall height the device needs to be placed in order to be reached is limited by the height of the user unless a ladder is to be used with the device. Where a second rack is used beneath a first rack, the height is appropriately sized.

The second rack is attached to the first rack also by a hinge. The hinge will allow the second rack to fold underneath the first rack and lay against the wall in a closed position. It will also allow the second rack to fold outward from the wall so that when the second rack bottom ends are positioned against the wall, the rack forms a mountain fold against the wall. A mountain fold is where the top of the first rack and the bottom of the second rack are against the wall less than the total length of the two combined such that the hinge joining them is away from the wall creating a mountain shape against the wall. The position of the fold can be limited by a stop limit in the hinge or by using a free rotating hinge and resting the bottom end of the second rack on a bottom horizontal bar or a ledge mounted on the wall. Another means could be a second rack below the first rack wherein the top horizontal bar becomes the ledge for resting the bottom of the top rack in the mountain fold position. Either way, the rack has a general open and closed configuration as shown in the figures. In general, the angle which the mountain fold creates is in one embodiment about 60 degrees to about 15 degrees against the wall though the exact angle that best utilizes space can be determined easily from the disclosure herein.

Now referring to the drawings, FIG. 1 depicts an embodiment of the invention in perspective. The drying rack 1 consists of horizontal wall mounting top bar 2 which has a pair of spaced apart wall spacers 3 which has been horizontally mounted on wall 30. The first rack 5 consists of vertical rod holders 6 and 7 which are parallel and spaced apart the same distance as the two wall spacers 3 and act as the sides of the first rack 5. Four drying rods 8 hold the rod holders 6 and 7 at the desired spaced apart distance so that each of their top ends 9 can be mounted to the wall spacers 3 by hinges 10.

The bottom end 12 of first rack 5 is attached to second rack 15 consisting of a pair of vertical rod holders 16 and 17 held in spaced configuration by drying rods 18. The top of the vertical rod holders 21 are attached to the bottom of the first rack 12 by hinge 22. The rack 1 in the open position, as shown, forms an angle 20 which then is a mountain fold against the wall. As shown in the figure, the angle 20 is about 45 degrees. The bottom of the second rack sides 25 rest against wall 30. The hinge 22 can have a stop, or in yet another embodiment, the friction of the end 25 against wall 30 can hold it in place.

FIG. 2 is a side view of another embodiment of the present invention. In this view, top bar 2 has the wall spacer incorporated into bar 2 by virtue of its thickness. In this view, ledge 26 holds the bottom edge 25 of the second rack to create the mountain fold against wall 30.

Figure 3:
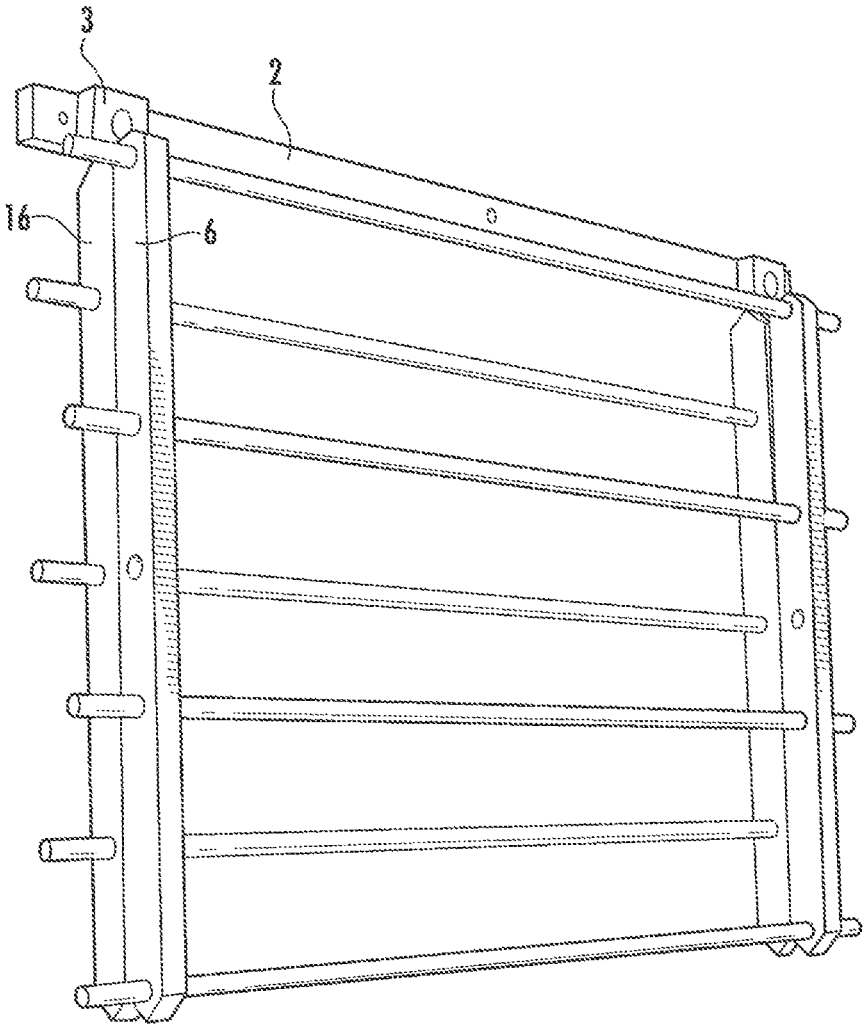
FIG. 3 is a perspective view of the present invention in the closed position.

FIG. 3 is a perspective view of the rack 1 shown in FIG. 1, however, it is now in the closed position wherein rack 15 is folded underneath rack 5 and against wall 30 in a storage position. Note how the spacers allow the proper distance so that the device lays flat against wall 30.

Figure 4:
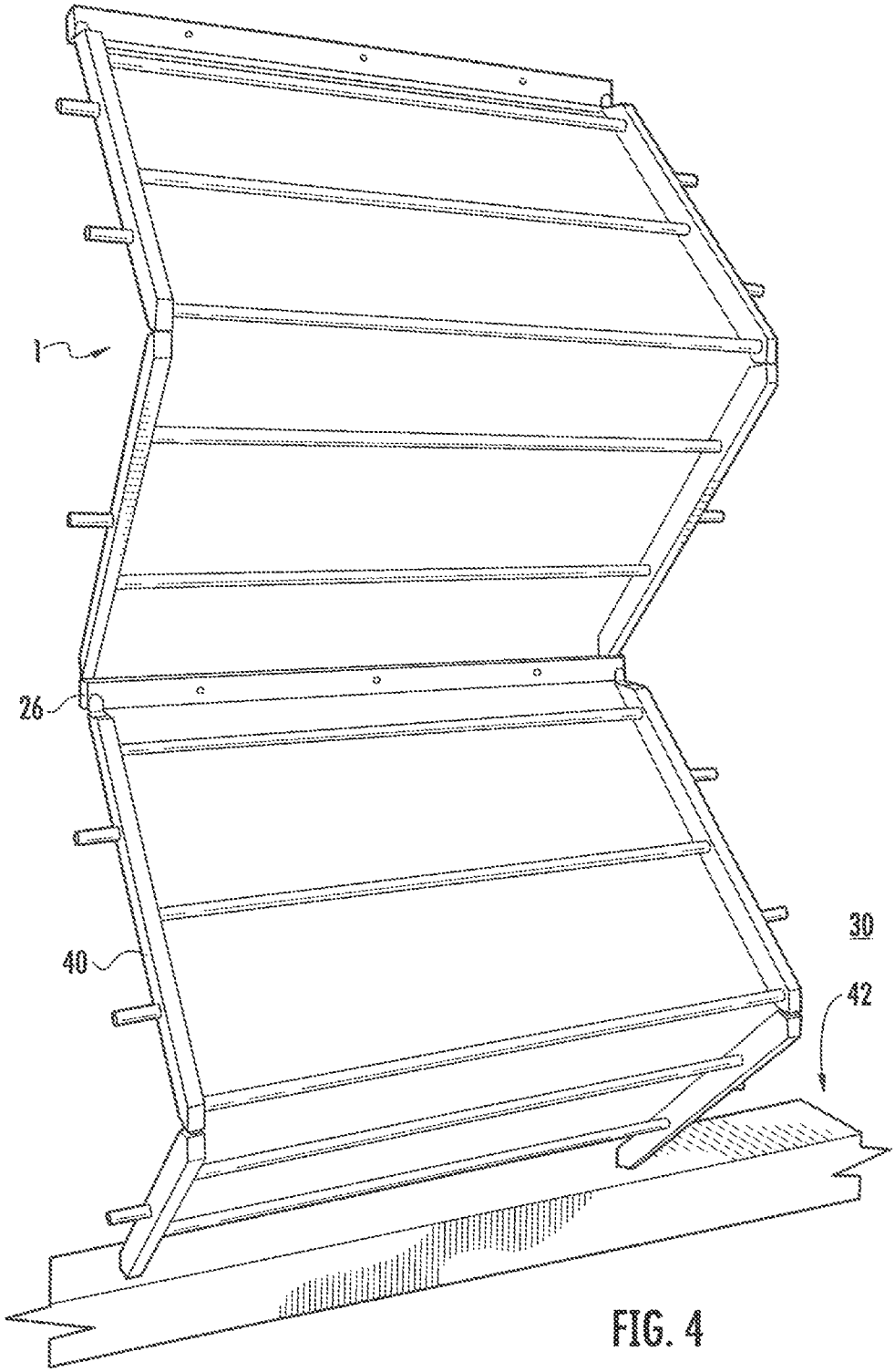
FIG. 4 is a perspective view of tandem racks of the present invention.

FIG. 4 is a perspective embodiment of two racks mounted on a wall, one on top of the other. In this embodiment, the top horizontal bar of rack 40 becomes the ledge 26 for rack 1, and the ledge for rack 40 is the floor 42.

The examples are not intended to be limiting though, certain embodiments are taught, though this statement is not understood to mean all embodiments are equal. The claims are to be given a reading based on the definitions herein.

What is claimed is:

1. A wet clothing drying system attached to a wall for drying two or more pieces of wet clothing comprising a folding clothes drying rack fixed to the wall surface comprising:

a) a horizontal wall mounting top bar attached directly to the wall having a pair of spaced apart wall spacers of a thickness such that the bar or bar plus the wall spacers is thick enough that when the rack is folded against the wall, it lays essentially flat;

b) first rectangular rack comprising:

i. a pair of vertical rod holders each having a top end and a bottom end, positioned for holding clothes drying rods in parallel spaced relationship;

ii. a plurality of clothes drying rods positioned between the rod holders such spaced to allow the hanging of the wet clothing; and iii. a hinge for attaching each of the top end of the vertical rod holders to the wall spacers or top bar;

c) a second rectangular rack comprising:

i. a pair of vertical rod holders each having a top end and a bottom end, positioned for holding clothes drying rods in parallel spaced relationship;

ii. a plurality of clothes drying rods positioned between the rod holders such spaced to allow the hanging of wet clothing; and iii. a hinge for attaching each of the top end of the vertical rod holders to the bottom end of the respective first rectangular rack vertical rod holders;

d) wherein the rack has a closed position wherein the second rack is folded underneath the first rack and up against the wall; and e) wherein the rack has an open position wherein the second rack is folded downward below the first rack such that the bottom end of the second rack bottom ends are against the wall forming a mountain fold against the wall at an angle from about 25 to about 150 degrees such that the horizontal rods are spaced apart such that they allow the wet clothing to dry without touching other wet clothing on the rack.

2. A rack according to claim 1 wherein the angle against the wall is held by using a hinge having a limit stop.

3. A rack according to claim 1 wherein the angle against the wall is held by using a ledge to rest the bottom end on.

4. A rack according to claim 1 wherein the angle against the wall is held by placing a second wall rack underneath the first rack such that the top bar of the second rack holds the bottom of the first rack in place.

5. A rack according to claim 1 wherein the second rack can fold underneath the first rack and lay flat against a wall to which it is mounted.

* * * * *